US007843422B1

(12) United States Patent
Ludden et al.

(10) Patent No.: US 7,843,422 B1
(45) Date of Patent: Nov. 30, 2010

(54) APPARATUS AND METHOD FOR AMBIENT LIGHT COMPENSATION FOR BACKLIGHT CONTROL IN SMALL FORMAT DISPLAYS

(75) Inventors: Christopher A. Ludden, Pittsford, NY (US); Imre Knausz, Fairport, NY (US)

(73) Assignee: National Semiconductor Corporation, Santa Clara, CA (US)

( * ) Notice: Subject to any disclaimer, the term of this patent is extended or adjusted under 35 U.S.C. 154(b) by 1371 days.

(21) Appl. No.: 11/289,103

(22) Filed: Nov. 29, 2005

(51) Int. Cl.
*G09G 5/00* (2006.01)

(52) U.S. Cl. ..... 345/102

(58) Field of Classification Search ..... 345/87, 345/89, 102, 204, 211, 212, 690; 348/554, 348/729; 349/61
See application file for complete search history.

(56) References Cited

U.S. PATENT DOCUMENTS

| | | | | |
|---|---|---|---|---|
| 5,717,422 | A | 2/1998 | Fergason | |
| 6,812,649 | B2 | 11/2004 | Kim | |
| 6,841,947 | B2 | 1/2005 | Berg-johansen | |
| 6,909,486 | B2 | 6/2005 | Wang et al. | |
| 7,602,371 | B2 * | 10/2009 | Sultenfuss et al. | 345/102 |
| 7,609,360 | B2 * | 10/2009 | Yamaguchi | 349/199 |

OTHER PUBLICATIONS

OSRAM Datasheet (2002) "Silicon PIN Photodiode with Very Short Switching Time," SFH 2400 and SFH 2400 FA, pp. 1-5, published by OSRAM Opto Semiconductors GmbH & Co. OHG.
OSRAM Datasheet (2002) "Silicon NPN Phototransistor with Vλ Characteristics," SFH 3410, pp. 1-5, published by OSRAM Opto Semiconductors GmbH & Co. OHG.
TDK Datasheet (2003) "Sensors: Optical / Visible Radiant Optical Sensors" BCS Series.
Choi, I. et al. (2003) "LPBP: Low-Power Basis Profile of the Java 2 Micro Edition," ISLPED '03, Seoul, Korea, pp. 36-39.
Chang, N. et al. (2004) "DLS: Dynamic Backlight Luminance Scaling of Liquid Crystal Display," IEEE Transactions on Very Large Scale Integration (VLSI) Systems, 12(8):837-846.
National Semiconductor Datasheet (2005) "Lighting Management System for Six White LEDs and One RGB or FLASH LED," LP3936, pp. 1-21, published by National Semiconductor Corp., www.national.com.

* cited by examiner

*Primary Examiner*—Abbas I Abdulselam
(74) *Attorney, Agent, or Firm*—Frommer Lawrence & Haug LLP; Matthew M. Gaffney

(57) ABSTRACT

An ambient light compensation circuit for controlling a backlight brightness is provided. The circuit automatically adjusts the LCD backlight brightness based on a reading of the ambient light. The circuit includes a non-linear ADC and a backlight control circuit. The non-linear ADC provides a digital signal from a photodiode signal. The backlight control circuit adjusts the brightness of the backlighting based on the digital signal. The brightness adjustment is performed gradually, e.g., one significant bit of the digital signal per second.

20 Claims, 4 Drawing Sheets

APPARATUS AND METHOD FOR AMBIENT LIGHT COMPENSATION FOR BACKLIGHT CONTROL IN SMALL FORMAT DISPLAYS

FIELD OF THE INVENTION

The invention is related to backlighting, and in particular, to an apparatus and method for automatically adjusting the LCD backlight brightness based on a reading of ambient light so that the host processor is completely off-loaded from actively controlling the backlight.

BACKGROUND OF THE INVENTION

Liquid Crystal Displays (LCDs) may be used in small mobile devices such as palm PCs, PDAs, and cell phones. An LCD requires a light source for illumination in order to display an image. For example, transmissive LCDs employ backlighting as a light source. White light-emitting diodes (LEDs) may be used for backlighting applications.

BRIEF DESCRIPTION OF THE DRAWINGS

Non-limiting and non-exhaustive embodiments of the present invention are described with reference to the following drawings, in which.

DETAILED DESCRIPTION

Figure 1:
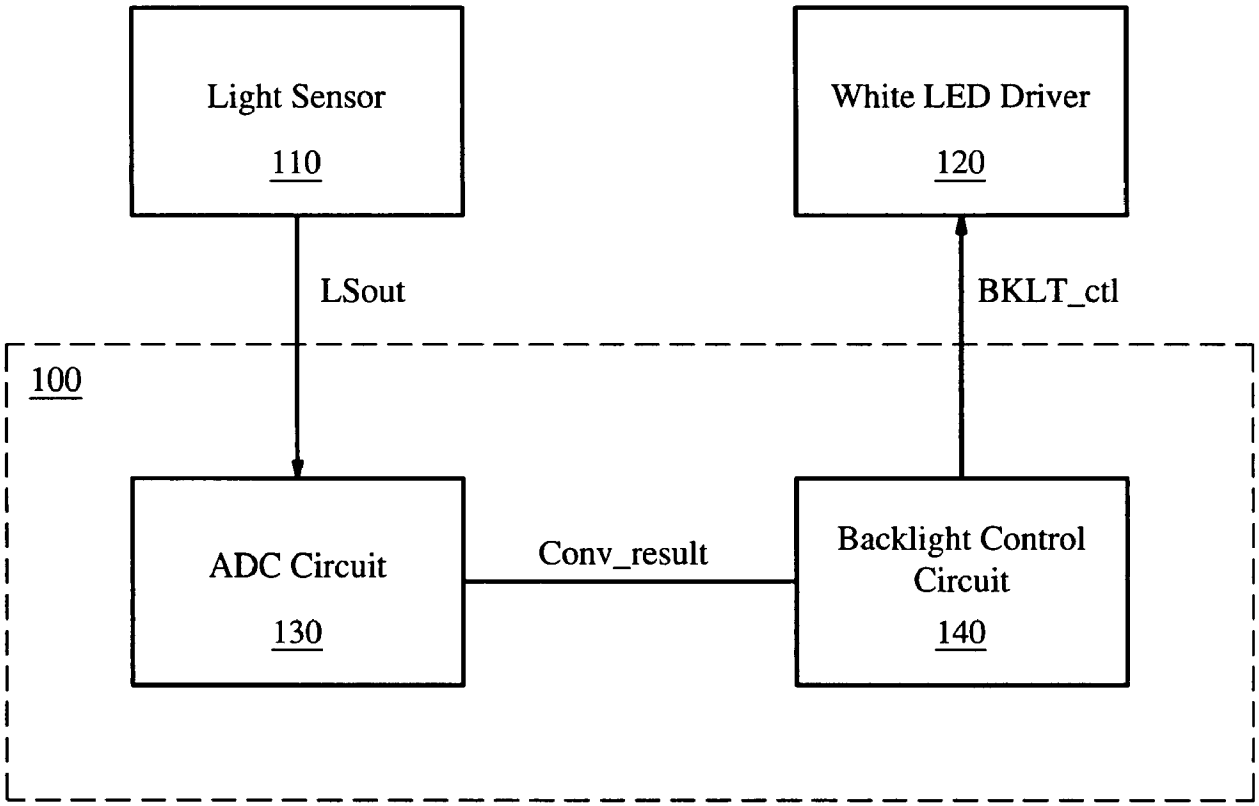
FIG. 1 shows a block diagram of an embodiment of an ambient light compensation circuit and external components.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data, or other signal. Where either a field effect transistor (FET) or a bipolar transistor may be employed as an embodiment of a transistor, the scope of the words "gate", "drain", and "source" includes "base", "collector", and "emitter", respectively, and vice versa.

Briefly stated, the invention is related to an ambient light compensation circuit for controlling a backlight brightness. The circuit automatically adjusts the LCD backlight brightness based on a reading of the ambient light. In one embodiment, the circuit includes a non-linear ADC and a backlight control circuit. The non-linear ADC provides a digital signal from a photodiode signal. Further, the backlight control circuit adjusts the brightness of the backlighting based on the digital signal. The brightness adjustment is performed gradually, e.g., one significant bit of the digital signal per second.

FIG. 1 shows a block diagram of an embodiment of ambient light compensation circuit 100 and external components including light sensor 110 and white LED driver 120. Circuit 100 includes ADC circuit 130 and backlight control circuit 140.

In operation, light sensor 110 senses the illuminance of ambient light, and provides signal LSout based on the sensed illuminance of the ambient light. In one embodiment, signal LSout is a voltage that is proportional to the sensed illuminance. In another embodiment, signal LS has a different mathematical relationship with the sensed illuminance.

ADC circuit 130 is operable to receive signal LSout, and to convert analog signal LSout into a digital signal, conversion output signal Conv_result. Further, ADC circuit 130 is operable to provide signal Conv_result such that the value of signal Conv_result is proportional to a logarithm of the sensed illuminance of ambient light. In one embodiment, ADC circuit 130 performs a non-linear analog-to-digital conversion so that signal Conv_result is proportional to the logarithm of the sensed illuminance. In another embodiment, ADC circuit 130 performs a linear ADC conversion and further analog and/or digital calculations such that signal Conv_result is proportional to the logarithm of the sensed illuminance.

In one embodiment, signal LSout is proportional to the sensed illuminance. In this embodiment, ADC circuit 130 provides signal Conv_result such that the value of Conv_result is proportional to the logarithm of analog signal LSout. In another embodiment, signal LSout has a non-linear relationship to the illuminance of the ambient light. In this embodiment, ADC circuit 130 corrects for this non-linearity as well as providing a logarithm function. Both non-linearity adjustments may be compensated for by employing a non-linear ADC conversion in one embodiment.

Backlight control circuit 140 is operable to adjust backlight control signal BKLT_ctl based on signal Conv_result. The brightness of the back-lighting is based on signal BKLT_ctl. Further, the brightness of the back-lighting may be adjusted by varying the magnitude of the LED current, the duty cycle of the LED current, or both. Accordingly, in one embodiment, backlight control circuit 140 changes the voltage of signal BKLT_ctl based on signal Conv_result. In another embodiment, backlight control circuit 140 is operable to provide signal BKLT_ctl as an oscillating signal, and to change the duty cycle of signal BKLT_ctl based on signal Conv_result.

Circuit 100 modulates the backlight brightness without involving the host processor, or any other microprocessor, in the process. In one embodiment, circuit 100 is included on the same integrated circuit as the column driver.

In one embodiment, minimum and maximum brightness settings may be employed. For example, below about 20 lux, the backlight should not be dimmed any further because there is a minimum needed for comfortable viewing. Also, above a certain ambient lighting luminance (e.g. 300 lux), the maximum brightness setting should be used. Within the minimum and maximum ambient lighting illumination bounds, the brightness of the back-lighting may be adjusted so that it is approximately proportional to the logarithm of the ambient lighting illuminance. This may be done because the human eye responds to light intensity in an approximately logarithmic fashion. A linear increase in perceived light intensity is actually a result of a logarithmic increase in light intensity.

In one embodiment, the change in brightness of the back-lighting does not occur instantly with changes in the ambient lighting illuminance. For example, in one embodiment, signal Conv_Result is a four-bit signal, and the change in brightness of the back-lighting is accomplished at a rate of about one least significant bit of signal Conv_result per pre-determined time interval (e.g., per second, per half-second, or the like). In this embodiment, with a change of one least significant bit of Conv_result per second, a change in ambient lighting conditions from 20 lux to 300 lux, or vice versa, may take about 16 seconds for the backlight brightness to be fully adjusted for the change. This may provide a filtering function. Also, digital averaging is performed in one embodiment.

In addition to providing brightness compensation based on ambient light conditions, in one embodiment, circuit 100 may provide brightness compensation based on other factors, such as image contrast.

Figure 2:
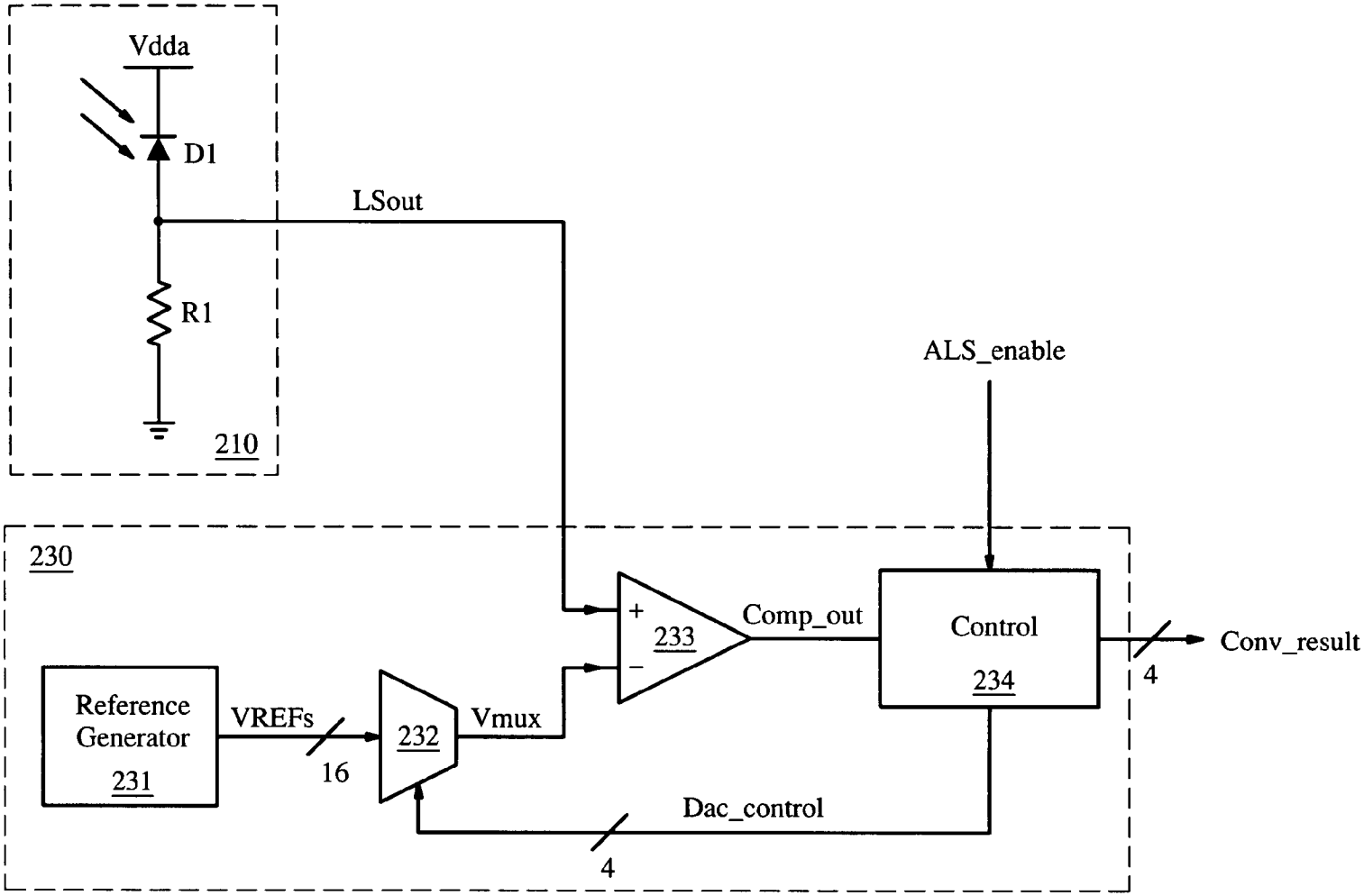
FIG. 2 illustrates a block diagram of an embodiment of the light sensor and ADC circuit of FIG. 1.

FIG. 2 illustrates a block diagram of an embodiment of light sensor 210 and ADC circuit 230, which may be employed as embodiments of light sensor 110 and ADC circuit 130, respectively, of FIG. 1. An embodiment of light sensor 210 includes photodiode D1 and resistor R1. An embodiment of ADC circuit 230 includes reference generator 231, analog multiplexer 232, comparator 233, and control block 234.

In operation, photodiode D1 provides a photodiode current responsive to ambient light. Also, resistor R1 is operable to provide a photodiode voltage responsive to the photodiode current. In the embodiment illustrated in FIG. 2, signal LSout is the photodiode voltage.

Until recently, photodiodes were non-ideal for measuring ambient light, since they were typically much more sensitive to infrared light than the spectrum of light that the human eye is sensitive too. With such a photodiode, an IR filter can to be used to match sensitivity to the human eye. However, currently, photodiodes that closely mimic the sensitivities of the human eye are commercially available from companies such as TDK Corporation and OSRAM Opto Semiconductors GmbH. Preferably, a photodiode that closely mimics the sensitivities of the human eye is used for photodiode D1. However, in another embodiment, a photodiode that is sensitive to infrared light in conjunction with an IR filter may be employed. In yet another embodiment, a light sensor other than a photodiode may be used, such as a Cadmium Sulfide (CdS) cell.

Reference generator 231 is operable to provide a plurality of reference voltages VREFs. In one embodiment, reference generator 231 is a resistor with sixteen voltage taps. In one embodiment, references voltages VREFs are spaced in a non-linear fashion so that a non-linear analog-to-digital conversion is performed.

In one embodiment, circuit 100 is integrated onto a column driver (not shown), and the gamma reference circuit is used to provide both the gamma reference signals (not shown) and further include voltage taps to provide signals VREFs. In one embodiment, in which the gamma reference circuit is also used as reference generator 231, the polarity signal (not shown) can vary as often as every line in line inversion and the reference voltages are only used during positive polarity.

In one embodiment, a linear A/D conversion is employed, and voltages VREFs are spaced in a linear manner. In another embodiment, voltages VREFs are spaced in a non-linear fashion to provide a non-linear A/D conversion. For example, voltages VREFs may be spaced such that the value of signal Conv_result is approximately proportional to a logarithm of signal LSout. Further, if photodiode D1 provides photodiode current such that the photodiode current has a non-linear relationship with the sensed illuminance, the spacing of voltage VREFs may also compensate for this non-linearity.

Multiplexer 232 is an analog N:1 multiplexer, wherein N is the number of reference voltages VREFs. Multiplexer 232 selects one of the reference voltages VREFs to provide as multiplexer output voltage Vmux based on selection signal Dac_control. Also, comparator 233 is operable to compare signal LSout with voltage Vmux, and to provide comparison output signal Comp_out based on the comparison. Additionally, control block 234 is operable to provide signal Conv_reult and signal Dac_control based on signal Comp_out.

In one embodiment, control block 234 consists of a counter (not shown) and a state machine (not shown). The counter is employed to trigger the A/D conversions every n frames (in one embodiment, this is accomplished by counting start vertical pulses [STVs]). In one embodiment, this control is register programmable. The state machine is operable to perform the A/D conversions and to report the result as digital signal Conv_result.

In one embodiment, the counter is employed to trigger the A/D conversion every n lines, or based on some other predetermined interval in time.

In one embodiment, the A/D conversion is done by setting dac_control to zero and checking comp_out to determine whether the voltage of LSout is greater than Vmux. If it is, then dac_control is incremented. In this embodiment, A/D linearly searches through the values until it finds the correct value.

In one embodiment, control block 234 receives ambient light sensing enable signal ALS_en. In this embodiment, the ambient light sensing function may be disabled by de-asserting signal ALS_en. If the ambient light sensing is disabled, the brightness is no longer modulated based on the ambient light. If signal ALS_en is subsequently re-enabled, the ambient light sensing function is resumed.

Although a particular embodiment of a light sensor is illustrated for light sensor 210, as previously discussed, other embodiments of light sensor 210 are within the scope and spirit of the invention. For example, CdS may be employed instead of a photodiode.

Similarly, although a particular embodiment of ADC circuit 230 is shown in FIG. 2 and described above, many other embodiments of ADC circuit 230 are within the scope and spirit of the invention. Also, although a simple linear search is described above, a variety of other algorithms for A/D conversion may be employed. For example, a binary search may be employed. These variations and others are within the scope and spirit of the invention.

Figure 3:
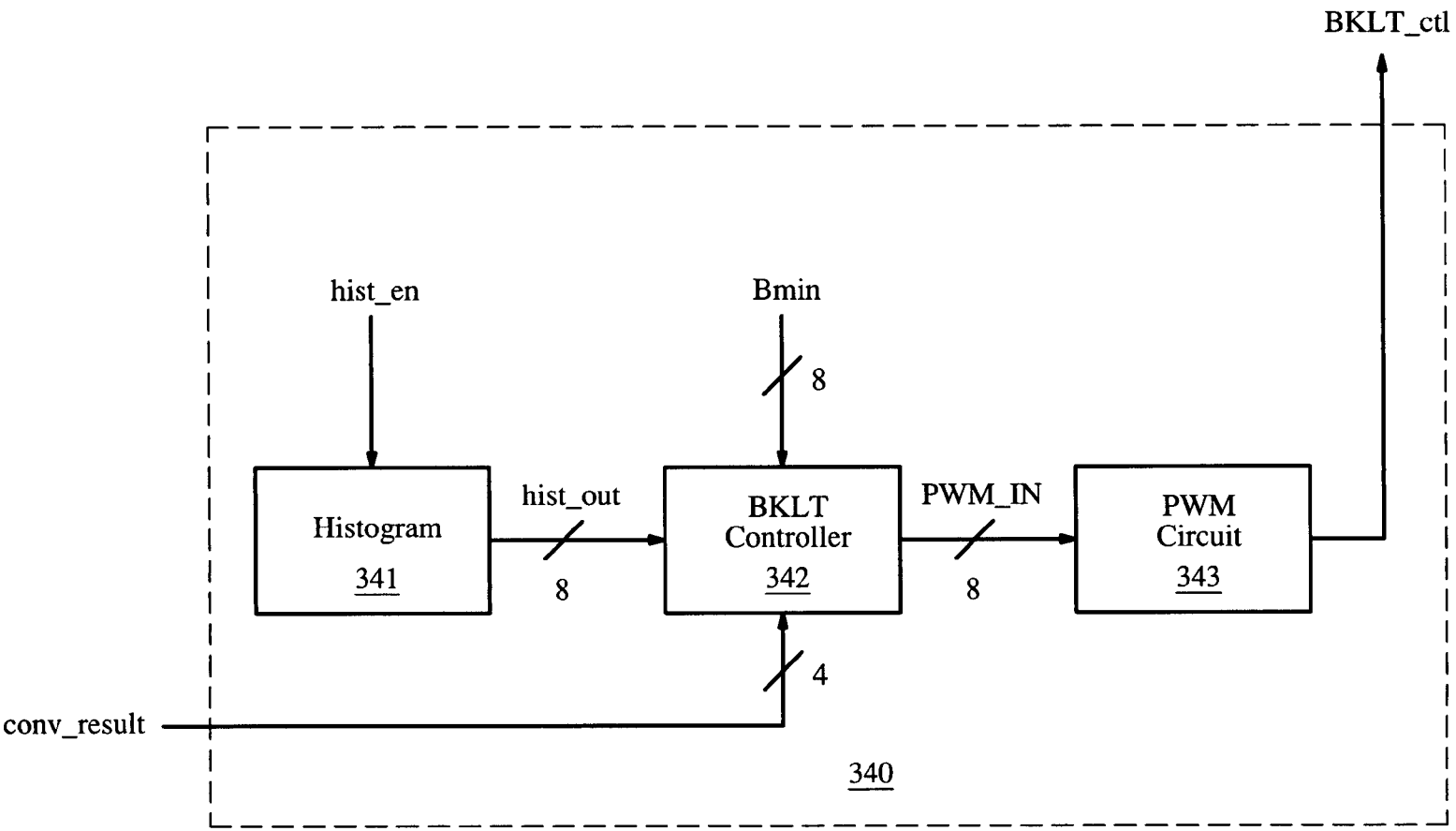
FIG. 3 shows a block diagram of an embodiment of the backlight control circuit of FIG. 1.

FIG. 3 shows a block diagram of an embodiment of backlight control circuit 340, which may be employed as an embodiment of backlight control circuit 140 of FIG. 1. Backlight control circuit 340 may include histogram block 341, backlight controller 342, and PWM circuit 343.

Although one embodiment of backlight control circuit 340 is illustrated in FIG. 3 and described below, many alternative embodiments are within the scope and spirit of the invention. Histogram block 341 is an optional element that need not be included in backlight control circuit 340. In one embodiment, backlight control circuit 340 adjusts the backlight brightness based on both ambient lighting conditions and the contrast characteristics of the image. In this case, histogram block 341 may be included in backlight control circuit 340, and employed to determine whether the displayed image is a high-contrast image. In another embodiment, backlight control circuit 340 adjusts the backlight brightness based on ambient lighting conditions, but not based on the contrast characteristics of the image. In this embodiment, histogram block 341 is not included in backlight control circuit 340.

Also, although PWM circuit 343 is included in the embodiment of backlight control circuit 340 illustrated in FIG. 3, in other embodiments, as previously discussed, the magnitude of the LED current may be modulated rather than the duty cycle. Additionally, although a particular number of bits for each signal are described for one embodiment, in other embodiments, a different number of bits may be employed for any or all of the digital signals. These embodiments and others are within the scope of the invention.

For the embodiment illustrated in FIG. 3, backlight control circuit 340 operates as follows.

Histogram 341 is operable to receive video data, to place the received video data into histogram bins, and to employ the resulting histogram to determine whether or not the image being displayed is a high contrast image. Histogram 341 provides signal hist_out, which is an eight-bit signal in one embodiment, where the value of hist_out is dependent on whether the displayed image is a high contrast image. Backlight controller 342 sends signal PWM_IN to PWM circuit 343. Signal PWM_IN is a digital signal. PWM circuit 343 provides backlight control signal BKLT_ctl such that the duty cycle of signal BKLT_ctl is approximately proportional to the value of signal PWM_IN. In one embodiment, backlight controller 342 receives three signals: signal conv_result (the A/D conversion result), signal Bmin, and signal hist_out. The A/D conversion result represents the brightness of ambient light. Bmin is a minimum brightness level below which the backlight is not dimmed. Further, in one embodiment, signal hist_out from the histogram block is one of two values—Bnorm, the normal image 8 bit PWM value and Bhigh, the PWM value to be used for high contrast images. If signal hist_en is de-asserted, disabling the histogram function, then Bnorm is the value of signal hist_out.

Figure 4:
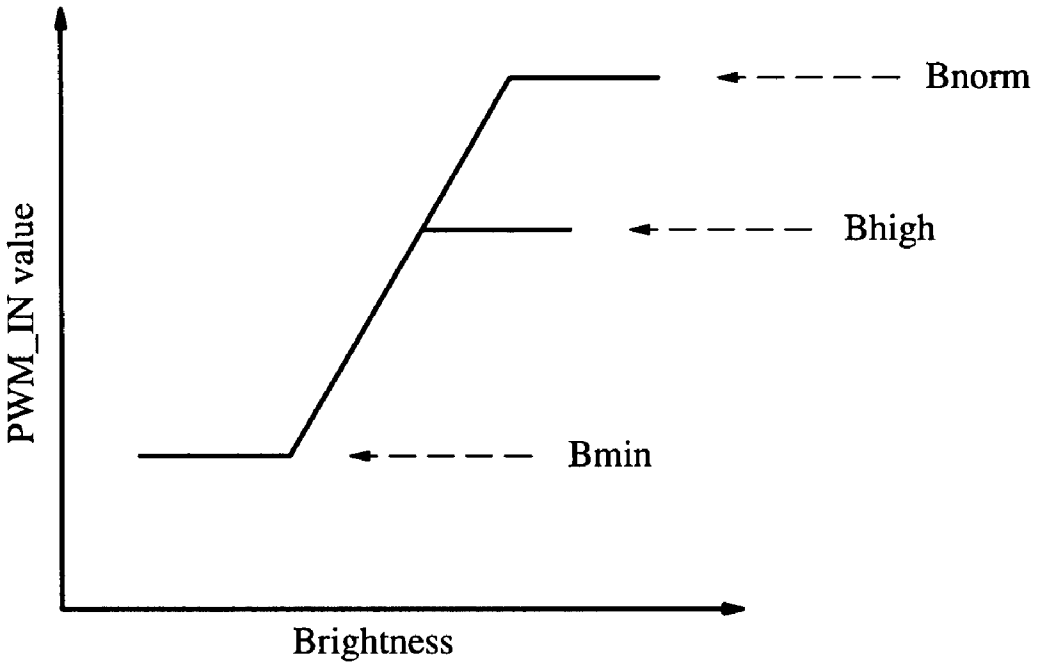
FIG. 4 illustrates a graph of the digital value of an embodiment of signal PWM_IN over brightness for an embodiment of the backlight control circuit of FIG. 3, in accordance with aspects of the invention.

FIG. 4 illustrates a graph of the digital value of an embodiment of signal PWM_IN over brightness for an embodiment of the backlight control circuit 342 of FIG. 3.

In one embodiment, backlight controller 342 modifies the 4 most significant bits (MSBs) of signal PWM_IN based on signal conv_result. In this embodiment, Backlight controller 342 takes the hist_out signal and reduces the 4 MSBs to the level of conv_result if the 4 MSBs are greater than conv_result. The resulting value for PWM_IN is not reduced below Bmin. Also, in one embodiment, the 4 MSBs of the PWM_IN signal do not change more than one step at a time (either up or down). In this way, signal PWN_IN is adjusted gradually based on ambient lighting conditions. For example:

hist_out=Bnorm because hist_en is false OR it is not a high contrast image.

Bnorm=11100010 (0xE2)

Conv_result=1001 (9)

Then the PWM_IN value will go down to 10010010 (0x92) one step at a time while Conv_result=1001 (9)

In one embodiment, Bnorm, Bhigh, and Bmin are register configurable.

Noise is an important consideration for the circuit. The photodiode may have a very fast response time, as opposed to CdS cells, and the output can potentially be jittery based on ambient noise such as 120 Hz noise from fluorescent light. In different embodiments, the noise may be filtered in different ways. In one embodiment, the noise is filtered by using an integrating ADC for ADC circuit 130 of FIG. 1. In another embodiment, a filter capacitor is used to provide low pass filtering. For example, a filter capacitor may be placed in parallel with resistor R1 of FIG. 2. In another embodiment, filtering is performed inside the integrated circuit by performing digital averaging. In this embodiment, the backlight controller averages 16 readings of signal conv_result, and the average value is used to determine signal PWM_IN, rather than using signal conv_result directly. In other embodiments, a number of readings other than 16 may be averaged, a median may be used rather than the average, or the like. In embodiments in which signal PWM_IN is adjusted gradually, this also provides a filtering function. In one embodiment, digital averaging and gradual adjustment of signal PWM_IN are both performed.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A circuit for back-lighting of a small-format display, comprising:

an analog-to-digital conversion circuit that is operable to receive an analog signal that is based, at least in part, on a sensed illuminance of ambient light; and to convert the analog signal in a conversion output signal, wherein the conversion output signal is a digital signal having a value, and wherein the analog-to-digital conversion circuit is integrated onto a column driver; and a backlight control circuit that is operable to receive the digital signal, and to control modulation of brightness of the back-lighting based, in part, on the digital signal, wherein the backlight control circuit is integrated onto the column driver, whereby the control of the modulation of the brightness of the back-lighting is accomplished without involvement of a microprocessor.

2. The circuit of claim 1, wherein the analog-to-digital conversion circuit is operable to perform a non-linear analog conversion such that a value of the digital signal is approximately proportional to a logarithm of a voltage of the analog signal.

3. The circuit of claim 1, wherein the backlight control circuit is operable to provide a backlight control signal such that a parameter of the backlight control signal is modulated based on the conversion output signal, and wherein the brightness of the back-lighting is approximately proportional to the modulated parameter of the backlight control signal.

4. The circuit of claim 3, wherein the parameter of the backlight control signal is at least one of a voltage or a duty cycle of the backlight control signal.

5. The circuit of claim 3, wherein the backlight control circuit is operable to provide the backlight control signal such that, if the digital signal changes, the parameter is gradually adjusted in proportion to the change, but such that the modulated parameter is not adjusted below a minimum bound or above a maximum bound, and such that the modulation is sufficiently gradual that a change in ambient light from 20 lux to 300 lux requires at least three seconds for the gradual modulation of the parameter to be complete.

6. The circuit of claim 1, wherein the column driver includes a gamma reference circuit; the gamma reference circuit includes a resistor string; the resistor string includes a first plurality of voltage taps and a second plurality of voltage taps; the gamma reference circuit is operable to provide a plurality of gamma reference voltages at the first plurality of voltage taps, and to provide a plurality of ambient light sensing reference voltages at the second plurality of voltage taps; and wherein the analog-to-digital conversion circuit is operable to receive the plurality of ambient light sensing reference voltages, and to perform analog-to-digital conversion employing the plurality of ambient light sensing reference voltages as reference voltages for the analog-to-digital conversion.

7. A circuit for back-lighting of a small-format display, comprising:

a reference voltage circuit that is operable to provide a plurality of reference voltages that span a voltage range non-linearly;

an analog-to-digital converter that is operable receive a photodiode voltage and the plurality of reference voltages, and to provide a digital signal by performing a non-linear analog-to-digital conversion based on the plurality of reference voltages to convert the photodiode voltage into a digital signal such that the digital signal has a value that is approximately proportional to a logarithm of a luminance of ambient light; and a backlight control circuit that is operable to provide a backlight control signal based, in part, on the digital signal, such that a parameter of the backlight control signal is modulated based, in part, on the value of the digital signal.

8. The circuit of claim 7, wherein the backlight control circuit is operable to provide the backlight control signal such that, if the digital signal changes, the parameter is gradually adjusted in proportion to the change, but such that the modulated parameter is not adjusted below a minimum bound or above a maximum bound.

9. The circuit of claim 7, wherein the reference voltage circuit includes a resistor with a plurality of voltage taps spaced in a non-linear manner to provide the plurality of references voltages.

10. The circuit of claim 7, further comprising a white LED driver and a column driver, wherein the analog-to-digital converter, the backlight controller circuit, the LED driver, and the column driver are all included on a single integrated circuit; and wherein a resistor string used in a gamma reference circuit of the column driver is also employed as the reference voltage circuit.

11. The circuit of claim 7, wherein the backlight control circuit is arranged to store the value of the digital signal at a plurality of times, and to modulate the parameter of the backlight control signal based on a median value of the digital signal over a pre-determined period of time.

12. The circuit of claim 7, wherein the backlight control circuit is arranged to store the value of the digital signal at a plurality of times, and to modulate the parameter of the backlight control signal based on an average value of the digital signal over a pre-determined period of time.

13. The circuit of claim 12, wherein the backlight control circuit is operable to provide the backlight control signal such that, if the average value changes, the parameter is gradually adjusted in proportion to the change, but such that the modulated parameter is not adjusted below a minimum bound or above a maximum bound, and such that the modulation is sufficiently gradual that a change in ambient light from 20 lux to 300 lux requires at least three seconds for the gradual modulation of the parameter to be complete.

14. The circuit of claim 12, wherein the modulated parameter of the backlight control signal is the duty cycle of the backlight control signal; and wherein the backlight control circuit includes:

a backlight controller that is operable to receive the digital signal and to provide a digital PWM input signal based, in part, on the average value of the digital signal; and a PWM circuit that is operable to provide the backlight control signal such that the duty cycle of the backlight control signal is pulse-width modulated based on the digital PWM input signal.

15. The circuit of claim 14, wherein the backlight controller is operable to receive a digital minimum bound signal indicating the minimum bound, to receive a digital maximum bound signal indicating the maximum bound, and to provide the digital PWM input signal value such that:

if the average value of the digital signal increases, and the digital PWM input signal has not reached the maximum bound, the value of the digital PWM input signal increases by an amount corresponding to one least significant bit of the digital signal;

if the average value of the digital signal decreases, and the digital PWM input signal has not reached the minimum bound, the value of the digital PWM input signal decreases by an amount corresponding to one least significant bit of the digital signal, such that the digital PWM input signal docs not change by more than one least significant bit of the digital signal for every pre-determined time interval.

16. The circuit of claim 15, further comprising a histogram block, wherein the histogram block is operable to determine whether a displayed image is a high-contrast image, and to provide the digital maximum bound signal such that the maximum bound is a first value if it is determined that the displayed image is a high-contrast image, and such that the maximum bound is a second value if it is determined that the displayed image is not a high-contrast image, wherein the second value is greater than the first value.

17. The circuit of claim 15, wherein the pre-determined time interval is at least 0.1 seconds.

18. A method for backlight modulation, comprising:

back-lighting a display such that a brightness of the display is based, in part, on a backlight control signal;

sensing an illuminance of ambient light;

providing an analog signal based on the illuminance of ambient light;

performing an analog-to-digital conversion on the analog signal to provide a digital signal having a value; and providing a backlight control signal based, in part, on the digital value such that a parameter of the backlight control signal is gradually modulated based, in part, on the digital value; and such that the modulation is sufficiently gradual that a change in ambient light from 20 lux to 300 lux requires at least three seconds for the gradual modulation of the parameter to be complete.

19. The method of claim 18, wherein providing the backlight control signal includes:

providing an average digital value based on a plurality of readings of the digital signal over time;

during each pre-determined interval:

if the average digital value is greater than a value corresponding to the current brightness and less than a maximum bound, incrementing a PWM input signal; and if the average digital value is less than a value corresponding to the current brightness and greater that a minimum bound, decrementing the PWM input signal; and providing the backlight control signal such that a duty cycle of the backlight control signal is approximately proportional to a value of the PWM input signal.

20. The method of claim 19, wherein the pre-determined time interval is at least 0.2 seconds.

* * * * *

UNITED STATES PATENT AND TRADEMARK OFFICE

CERTIFICATE OF CORRECTION

PATENT NO. : 7,843,422 B1
APPLICATION NO. : 11/289103
DATED : November 30, 2010
INVENTOR(S) : Christopher A. Ludden et al.

It is certified that error appears in the above-identified patent and that said Letters Patent is hereby corrected as shown below:

In column 2, line 50-59, delete "BKLT_ctl based on signal Conv_result. The brightness of the back-lighting is based on signal BKLT_ctl. Further, the brightness of the back-lighting may be adjusted by varying the magnitude of the LED current, the duty cycle of the LED current, or both. Accordingly, in one embodiment, backlight control circuit 140 changes the voltage of signal BKLT_ctl based on signal Conv_result. In another embodiment, backlight control" and insert the same on Col. 2, Line 49, after "signal" as a continuation of the Paragraph.

In column 8, line 21, in claim 15, delete "docs" and insert -- does --, therefor.

Signed and Sealed this
Twenty-sixth Day of April, 2011

David J. Kappos

David J. Kappos
*Director of the United States Patent and Trademark Office*